US008968163B1

(12) United States Patent
Vidmar

(10) Patent No.: US 8,968,163 B1
(45) Date of Patent: Mar. 3, 2015

(54) UNWEIGHTED THERAPY AND TRAINING DEVICE

(76) Inventor: David J. Vidmar, Ashland, OR (US)

( * ) Notice: Subject to any disclaimer, the term of this patent is extended or adjusted under 35 U.S.C. 154(b) by 430 days.

(21) Appl. No.: 13/363,161

(22) Filed: Jan. 31, 2012

Related U.S. Application Data

(60) Provisional application No. 61/462,440, filed on Feb. 3, 2011.

(51) Int. Cl.

| | |
|---|---|
| ***A47D 13/04*** | (2006.01) |
| ***A61H 3/00*** | (2006.01) |
| ***A63B 22/00*** | (2006.01) |
| ***A63B 22/02*** | (2006.01) |
| ***A63B 1/00*** | (2006.01) |
| ***A63B 69/00*** | (2006.01) |

(52) U.S. Cl.
CPC ..... *A61H 3/008* (2013.01); *A63B 69/0064* (2013.01)
USPC ..... 482/69; 482/43; 482/54

(58) Field of Classification Search
CPC ..... A63B 22/02; A63B 22/0235; A63B 22/0242; A63B 22/0257; A63B 22/0285; A63B 69/0064; A63B 7/00; A63B 7/02; A63B 21/00079; A63B 21/00138; A63B 21/00145; A63B 21/00149; A63B 21/00152; A63B 21/00178; A63B 21/00181; A63B 21/14; A63B 21/1403; A63B 21/1411; A63B 21/1415; A63B 21/1419; A63B 26/003; A63B 2208/0285; A63B 2208/029; A61H 3/008
USPC ..... 482/23–24, 38, 43, 51, 54, 69–71, 74, 482/91, 92–94, 95, 96, 139, 142, 143, 149, 482/41; 119/700; 601/23, 27, 33–35; 135/66–67; 297/273–282, 468–469, 297/483–484, 487–488
See application file for complete search history.

(56) References Cited

U.S. PATENT DOCUMENTS

| | | | | |
|---|---|---|---|---|
| 4,164,350 | A * | 8/1979 | Zeijdel et al. | 482/69 |
| 4,776,581 | A | 10/1988 | Shepherdson | |
| 5,133,339 | A | 7/1992 | Whalen et al. | |
| 5,569,129 | A * | 10/1996 | Seif-Naraghi et al. | 482/69 |
| 7,275,554 | B2 * | 10/2007 | Mullholand | 135/67 |
| 7,900,940 | B1 | 3/2011 | Vidmar | |
| 8,007,405 | B2 | 8/2011 | Burnfield et al. | |
| 2002/0022554 | A1 | 2/2002 | Borsheim | |
| 2009/0275867 | A1 * | 11/2009 | Santos-Munne et al. | 601/5 |
| 2010/0000546 | A1 * | 1/2010 | Park | 128/845 |
| 2011/0120567 | A1 | 5/2011 | Kuehne et al. | |

* cited by examiner

*Primary Examiner* — Oren Ginsberg
*Assistant Examiner* — Jennifer M Deichl
(74) *Attorney, Agent, or Firm* — Jerry Haynes Law

(57) ABSTRACT

An unweighted therapy, exercise and training device includes a device frame including a device frame base having a treadmill space sized and configured to accommodate a treadmill platform of a treadmill, an upper frame portion carried by the device frame base and having a frame interior and a pelvic suspension saddle and brace assembly having a saddle carried by the device frame and disposed in the frame interior.

18 Claims, 5 Drawing Sheets

UNWEIGHTED THERAPY AND TRAINING DEVICE

CROSS-REFERENCE TO RELATED APPLICATIONS

This application claims the benefit of U.S. provisional application No. 61/462,440, filed Feb. 3, 2011 and entitled "UNWEIGHTED THERAPY AND TRAINING DEVICE", which provisional application is incorporated by reference herein in its entirety.

FIELD OF THE INVENTION

Embodiments of the disclosure generally relate to gait training devices for exercise and rehabilitation. More particularly, embodiments of the disclosure generally relate to an unweighted therapy, exercise and training device which is suitable for supporting a client during each complete gait cycle in a completely weightless or partially weightless manner for gait training, fitness and sports performance enhancement.

BACKGROUND OF THE INVENTION

In the new field of Body Weight Supported Treadmill Training (BWSTT), used for human gait training in rehabilitation, fitness and sports performance enhancement, there have been previously two methods of lifting the body weight of clients or patients off of the ground or off of a treadmill. The most common and oldest method uses various types of parachute-like harnesses fit to the body, and then attached to a lifting frame or other apparatus whereby the body weight of the client could be partially removed during gait training. A second method exists in the field of BWSTT where the client is lifted in a chamber of air where a pressure differential can be altered to partially remove the body weight of the client.

Patients who suffer from various orthopedic and neurological conditions, such as hip replacement or stroke, for example, frequently suffer from limited movement capability severely compounded by the weight of the body. As such, the legs of such patients may not be able to completely or even partially bear the patient's weight during gait training. Further, many people are not able to fitness train because of the weight of their bodies causing pain to various orthopedic conditions and cumulative impact injuries to even healthy tissue while running or walking on treadmills. Further yet, many athletes benefit from performance enhancement capabilities such as over-speed training, stride lengthening, power and interval training without impact damage and with fewer recovery days In the field of BWSTT, there exists the need to which the present invention is addressed for a portable, affordable, unweighted therapy, exercise and training device which is capable of supporting a client in a completely weightless and partially weightless manner during each complete gait cycle while engaged in rehabilitative gait training, fitness exercise and sports performance enhancement exercise; and the need for a device is tolerable for long time period treatment; and the need to allow for differential weight bearing to each leg; and to allow for lifting the legs from the treadmill completely between strides allowing the user to run or walk faster or slower than the treadmill speed.

OBJECT OF THE INVENTION

Accordingly, it is the object of this invention to provide an improved device for both the complete (non-weight bearing) and partial body unweighting of clients by pelvic suspension throughout each complete cycle of gait during even long session rehabilitative gait training and exercise, fitness exercise, and sports performance enhancement exercise; and to provide for differential weight bearing for each leg and to allow for lifting the legs from the treadmill completely between strides allowing the user to run or walk faster or slower than the treadmill speed. It is a further object of this invention to provide multiple additional functions which in combination can meet needs not fulfilled by prior art.

The invention, then, further provides for the portability and partibility of the device for convenience. It provides wheels and a method of using said wheels to allow clients to ambulate over the ground, and a method to allow the device to pass a wheel chair assisted client under the device to be raised into the standing position and then rolled over a treadmill or over the ground. It further provides for the use of a fall arresting harness or a balance harness allowing clients with balance impairments or frailty of the aged to ambulate freely without fear of falling. The device provides for complete and unencumbered access to the limbs of a client while training, allowing for manual facilitation, cueing and correction of gait abnormalities. The device provides multiple straps for adjusting the exemplary and unique pelvic suspension saddle and brace assembly to allow saddle position adjustments that will accommodate comfortable inclinations for various back conditions.

SUMMARY OF THE INVENTION

According to the foregoing objectives, this invention describes an improved device for rehabilitative gait training and exercise, fitness exercise, and sports performance enhancement exercise and is generally directed to an unweighted therapy, exercise and training device utilizing a unique pelvic suspension system. An illustrative embodiment of the device includes a device frame including a device frame base having a treadmill space, sized and configured to accommodate a treadmill platform of a treadmill, an upper frame portion carried by the device frame base and having a frame interior and a unique pelvic suspension saddle and brace assembly having a saddle carried by the device frame and disposed in the frame interior.

BRIEF DESCRIPTION OF THE DRAWINGS

Illustrative embodiments of the disclosure will now be described, by way of example, with reference to the drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is non-limiting and is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "upper", "lower", "above", 'below", "top", "horizontal" and "vertical" as used herein are intended for descriptive purposes only and are not necessarily intended to be construed in a limiting sense.

Figure 1:
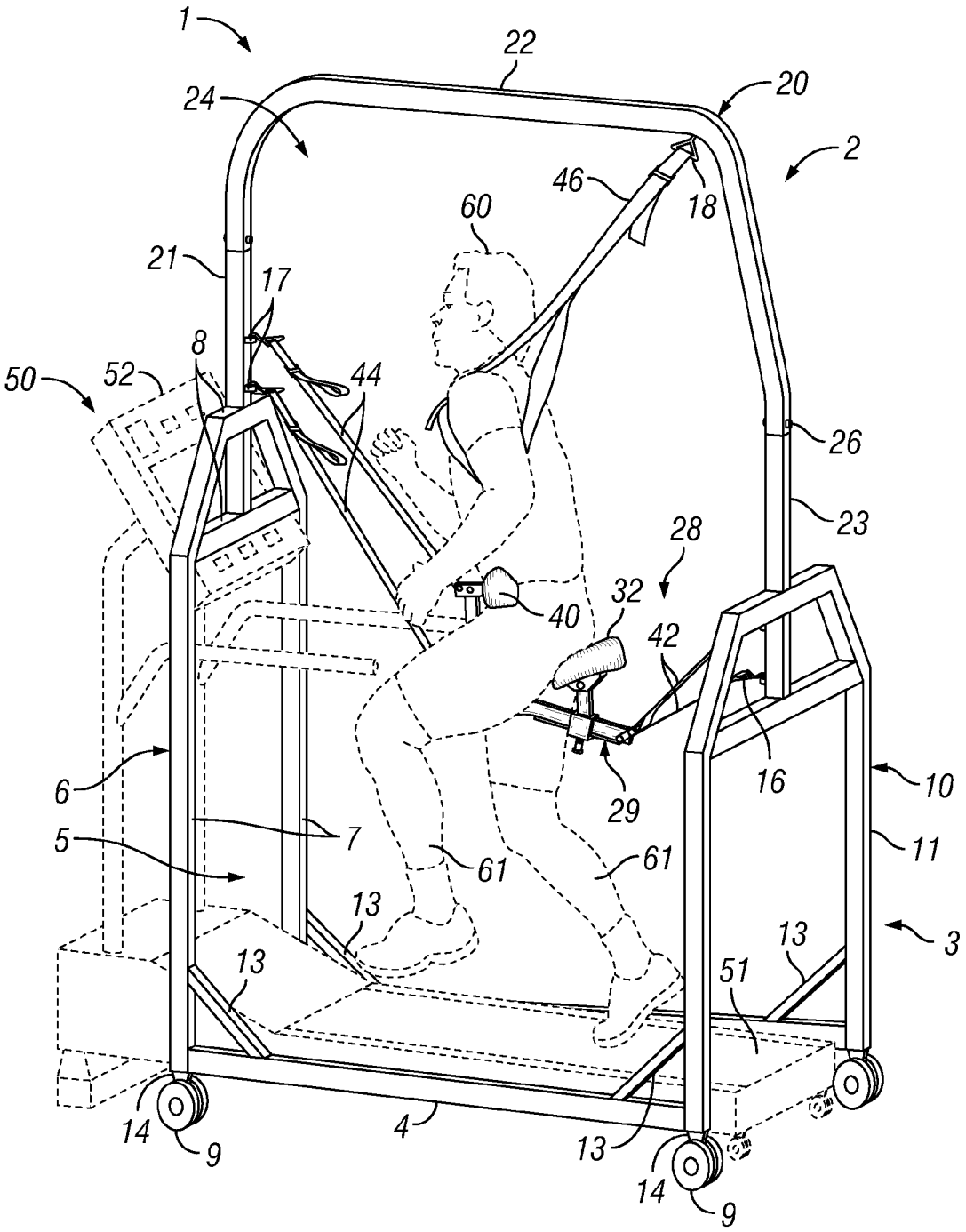
FIG. 1 is a side perspective view of an illustrative embodiment of the unweighted therapy, exercise and training device, with a treadmill positioned in the device and a user running on the treadmill in exemplary application of the device.
Figure 2:
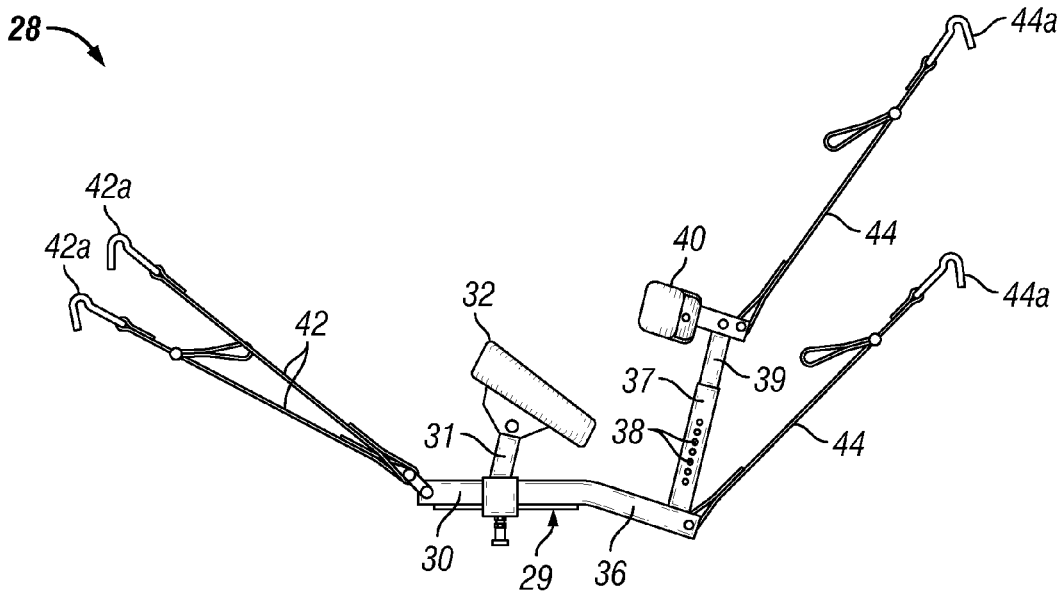
FIG. 2 is a side view of an exemplary pelvic suspension saddle and brace assembly suitable for an illustrative embodiment of the unweighted therapy, exercise and training device.
Figure 3:
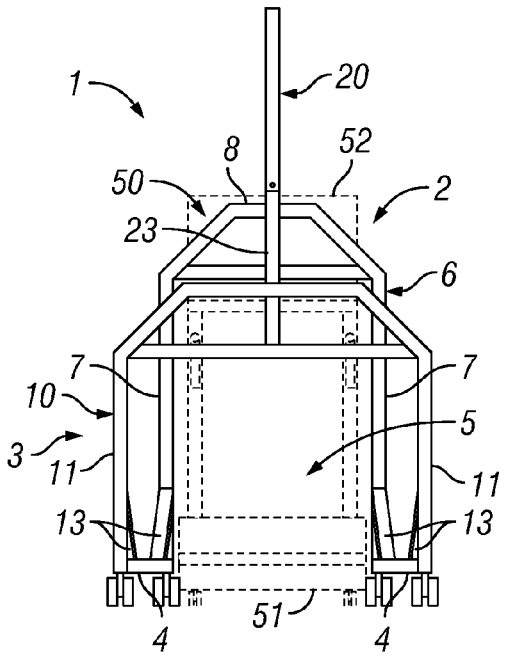
FIG. 3 is a rear view of an illustrative embodiment of the unweighted therapy, exercise and training device, with a treadmill (illustrated in phantom) positioned in the device.

Referring initially to FIGS. 1-3 of the drawings, an illustrative embodiment of the unweighted therapy, exercise and training device, hereinafter device, is generally indicated by reference numeral 1. The device 1 includes a device frame 2 which may include a device frame base 3. The device frame base 3 may include a pair of generally elongated, parallel, spaced-apart side base frame segments 4. In some embodiments, each side base frame segment 4 may have a wheel pad receiver 14. Each wheel pad receiver 14 may be adapted to facilitate attachment of a corresponding frame wheel 9 (FIG. 4) to the device frame base 3, such as in the conventional manner.

The device frame base 3 of the device frame 2 may further include a front base frame portion 6 which extends from the side base frame segments 4. The front base frame portion 6 may include a pair of generally elongated, parallel, spaced-apart front base frame members 7 which extend upwardly from the respective side base frame segments 4. At least one connecting member 8 may connect the front base frame members 7.

The device frame base 3 may further include a rear base frame portion 10. The rear base frame portion 10 may include a pair of generally elongated, parallel, spaced-apart rear base frame members 11 which extend upwardly from the respective side base frame segments 4. At least one connecting member 12 may connect the rear base frame members 11. Frame braces 13 may extend between each side base frame segment 4 and each front base frame member 7 and each rear base frame member 11 for reinforcing purposes. A treadmill space 5 may be formed by and between the side base frame segments 4, the front base frame portion 3 and the rear base frame portion 10 for purposes which will be hereinafter described.

An upper frame portion 20 may be supported by the front base frame portion 6 and the rear base frame portion 10 of the device frame base 3. The upper frame portion 20 may include a front frame segment 21 which extends generally upwardly from the front base frame portion 6. A generally curved top frame segment 22 may extend rearwardly from the front frame segment 21. A generally curved rear frame segment 23 may extend rearwardly and downwardly from the top frame segment 22. As illustrated in FIG. 3, the rear frame segment 23 may be welded and/or otherwise attached to the rear base frame portion 10 of the device frame base 3. A frame interior 24 may be formed by and between the front frame segment 21, the top frame segment 22 and the rear frame segment 23 of the upper frame portion 20.

As further illustrated in FIG. 1, in exemplary application of the device 1, which will be hereinafter described, a pelvic suspension saddle and brace assembly 28 may be suspended in the frame interior 24 of the upper frame portion 20. As illustrated in FIG. 2, the pelvic suspension saddle and brace assembly 28 may include an assembly frame 29. The assembly frame 29 may include a saddle supporting portion 30 and a brace supporting portion 36. A saddle support shaft 31 may extend from the saddle supporting portion 30. A saddle 32 may be supported by the saddle support shaft 31.

As further illustrated in FIG. 2, a brace support shaft 37 may extend from the brace supporting portion 36 of the assembly frame 29. A brace neck 39 may be telescopically extendable from the brace support shaft 37. A user brace 40 may be provided on the brace neck 39. In some embodiments, the user brace 40 may be padded and may be configured in a generally curved or arced configuration. The brace neck 39 may be telescopically adjusted in the brace support shaft 37 to selectively adjust the height of the user brace 40. A pin (not illustrated) may be inserted through a selected pin opening 38 in the brace support shaft 37 and through a registering pin opening (not illustrated) in the brace neck 39 to secure the user brace 40 at the selected height according to the preferences of the user.

The pelvic suspension saddle and brace assembly 28 may be suspended in the frame interior 24 of the upper frame portion 20 according to any suitable technique which is known by those skilled in the art. In some embodiments, at least one rear strap attachment point 16 may be provided on the rear frame segment 23 of the upper frame portion 20. At least one front strap attachment point 17 may be provided on the front frame segment 21 of the upper frame portion 20. In some embodiments, at least one top strap attachment point 18 may be provided on the top frame segment 22 of the upper frame portion 20. In some embodiments, the rear strap attachment point or points 16, the front strap attachment point or points 17 and the top strap attachment point or points 18 may include a D-ring or the like.

At least one rear attachment strap 42 may be attached to the saddle supporting portion 42 of the assembly frame 29 and to at least one of the rear strap attachment points 16. Each rear attachment strap 42 may terminate in an attachment hook **42*a* to facilitate attachment of the rear attachment strap 42 to the rear strap attachment point 16. At least one front attachment strap 44 may be attached to the brace supporting portion 36 of the assembly frame 29 and/or to the brace neck 39. In some embodiments, a pair of front attachment straps 44 may be attached to the brace supporting portion 36 and the brace neck 39, as illustrated. Each front attachment strap 44 may terminate in an attachment hook 44*a* to facilitate attachment of the front attachment strap 44 to the front strap attachment point 17. Each rear attachment strap 42 and each front attachment strap 44 may be length-adjustable to facilitate for-aft and vertical positional adjustment of the saddle and brace assembly 28. As illustrated in FIG. 1, in some embodiments, a shoulder strap 46 may be attached to the top strap attachment point 18 on the top frame segment 22 of the upper frame portion 20. The shoulder strap 46 may be adapted for use as a vest like balance harness to stabilize the erect position of the user 60 or to an extension under the arm and over the shoulder of the user 60 to arrest an unexpected fall of the user 60 on the saddle 32 of the pelvic suspension saddle and brace assembly 28 during use of the device 1**, which will be hereinafter described.

As further illustrated in FIG. 1, in exemplary application, which will be hereinafter described, the device 1 may be used with a treadmill 50. The treadmill 50 may be conventional and includes a treadmill platform 51 and a treadmill display 52 upward-standing from the treadmill platform 51. In use of the device 1, which will be hereinafter further described, the treadmill platform 51 of the treadmill 50 may be positioned in the treadmill space 5 (FIG. 3) between the side base frame segments 4 of the device frame base 3. In some embodiments, the treadmill 50 may be fastened or integrally attached to the device frame 2 according to the knowledge of those skilled in the art.

The device frame 2, the pelvic suspension saddle and brace assembly 28 and other components of the device 1 may include commonly found tubing or any other sufficiently rigid and strong material such as high-strength plastic, metal and the like, webbing, vinyl, padding, paints, wire, nuts and bolts. In some embodiments, the device frame 2 may be constructed as an integral part of the treadmill 50 where the pelvic suspension saddle and brace assembly 28 may be supported by the flexible rear attachment strap or straps 42 and front attachment strap or straps 44. In some embodiments, an adjustable, rotatable post (not illustrated) or other support structure which is known by those skilled in the art may support the pelvic suspension saddle and brace assembly 28 in the frame interior 24. In some embodiments, the device frame 2 may be constructed with partible joints 26 to facilitate collapsing the device frame 2 for ease of transport and storage.

Referring again to FIGS. 1 and 2 of the drawings, in exemplary application, the device 1 may be used in the field of body weight support treadmill training (BWSTT) for corrective gait training of a user 60 having compromised standing or ambulatory ability due to a stroke or other medical condition. Accordingly, the treadmill platform 51 of the treadmill 50 is placed in the treadmill space 5 (FIG. 3). The user 60 steps onto the treadmill platform 51. In some cases, a therapist (not illustrated) may assist the user 60 onto the treadmill platform 51. The user 60 places the pelvic ischial tuberosities or, alternately, the sacrum at the coccyx on the saddle 32, which may be set at an angle sufficient to allow an unrestricted range of extension and flexion of the user's hips and legs 61. The user 60 adjusts the front attachment straps 44 and the rear attachment straps 42 to achieve an upright ambulatory stature, dons the shoulder strap 46 as desired and then walks or runs on the treadmill platform 51 as the treadmill 50 is operated. The therapist may manually assist the user 60 in proper limb motion to correct for gait abnormalities. The pelvic hip bones (ASIS, or anterior superior iliac spine) rest against the padded user brace 40 and therefore, capture and support the pelvis in counterpoise between the ASIS and Ischium. With the pelvis of the user 60 thusly held within the pelvic suspension saddle and brace assembly 28, a range of from zero up to 100% of the user's body weight can be lifted by shortening the rear adjustment strap or straps 42 and/or the front adjustment strap or straps 44 to rest the user's feet on the treadmill platform 51 of the treadmill 50 and establish a desired knee bend for the specific treatment or workout desired. By this adjustment, varying degrees of ground reaction force across a range from zero to 100% body weight can easily be achieved.

As the treadmill 50 is operated, the user simulates a walking motion on the moving treadmill platform 51. Therefore, the treadmill platform 51 enables the user 60 to ambulate in place on level terrain for corrective gait training of the user 60. The user 60, supported in the pelvic suspension saddle and brace assembly 28, will not experience pressure on the sensitive perineal tissues at the crotch or the restrictions and pain normally associated with use of harnesses or undue pressure on hands, arms, elbows, and shoulders associated with parallel bars and other conventional equipment. The user 60 may experience significantly more core muscle challenges and balance challenges than can be attained using conventional equipment and methods known by those skilled in the art. When not in use, the device 1 may be collapsed by rotating at the partible joints 26 and typically may be transported through a standard doorway.

Throughout use of the device 1, the user brace 40 comfortably grasps the user 60 by the ASIS (anterior superior iliac spine), which is held in counterpoise to the ischium with no pressure on the crotch. The rear attachment straps 42 and the front attachment straps 44 maintain the saddle assembly 28 in a raised position such that the user 60 is weightless to partially weighted on the treadmill platform 51. Therefore, up to 100% of the body weight of the user 60 is transferred from the saddle 32 through the rear attachment straps 42 and the front attachment straps 44 to the device frame 2, which may be quickly assembled and fit over a conventional treadmill 50 or fabricated in one piece with a treadmill 50 so that the patient 60 may be unweighted from full body weight to completely unweighted or toe touch on the treadmill platform 51, facilitating unrestricted gait training. Moreover, the design of the device 1 may allow a therapist access for manual manipulation of the legs of the user 60 for the facilitation or cued correction of gait abnormalities. It will be appreciated by those skilled in the art that in embodiments in which the treadmill 50 is separable from the device 1, the device 1 can be rolled away from the treadmill 50 for storage and to allow the treadmill to be used as a treadmill.

Figure 4:
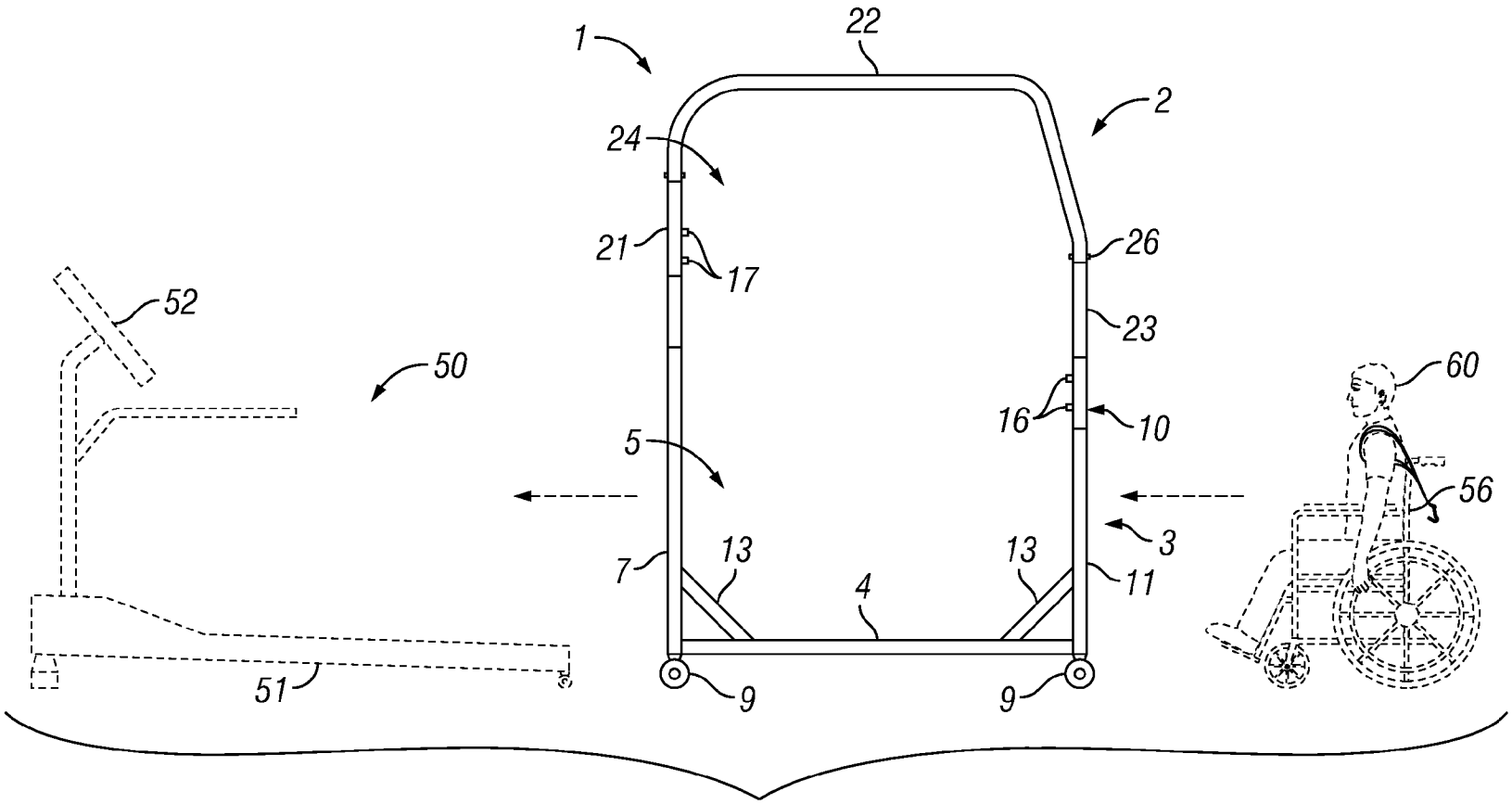
FIG. 4 is a side view of an illustrative embodiment of the unweighted therapy, exercise and training device, with a treadmill and a wheelchair-bound user in proximity to the device preparatory to use of the device.
Figure 5:
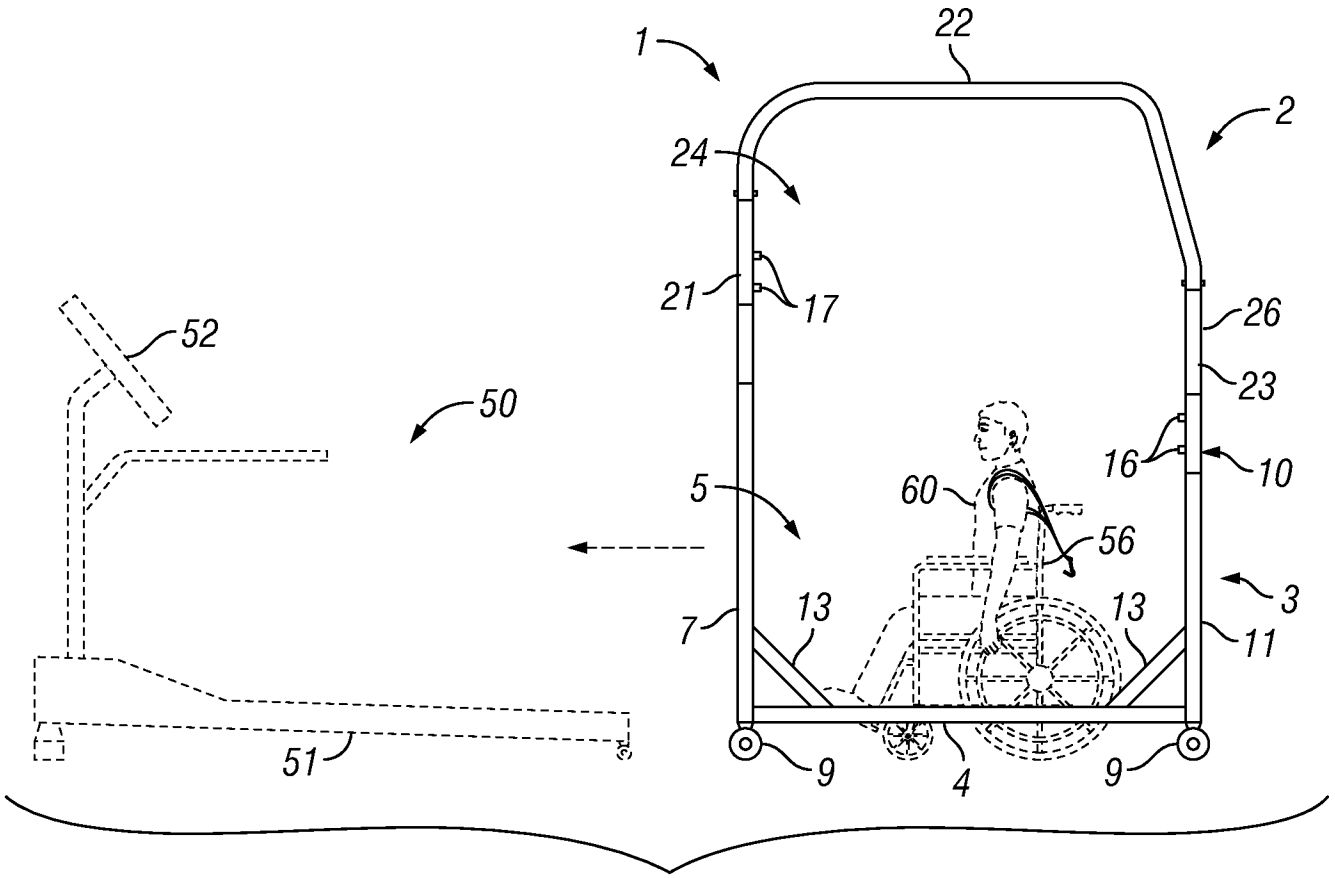
FIG. 5 is a side view of an illustrative embodiment of the unweighted therapy, exercise and training device, with the wheelchair-bound user positioned in the device and the treadmill adjacent to the device.
Figure 6:
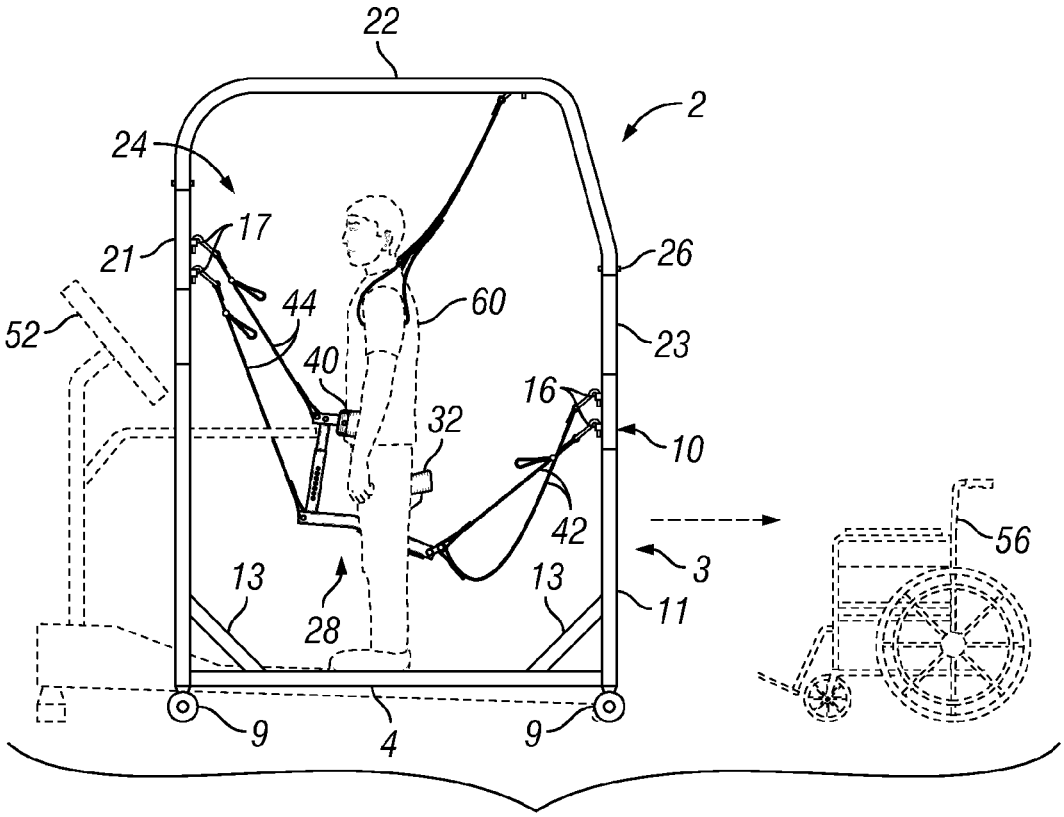
FIG. 6 is a side view of an illustrative embodiment of the unweighted therapy, exercise and training device, with the user seated in the pelvic suspension saddle and brace assembly and suspended over the treadmill in exemplary use of the device.

Referring next to FIGS. 4-6 of the drawings, the device 1 can be used by a person who depends primarily or exclusively on a wheelchair 56 for transportation. Accordingly, as illustrated in FIG. 4, the device 1 may initially be rolled in place over the user 60 as the user 60 sits in the stationary wheelchair 56. Thus, the treadmill space 5 (FIG. 3) in the device frame base 3 receives the wheelchair 56 and the user 60 seated therein as the wheelchair 56 is rolled between the rear base frame members 11 of the rear base frame portion 10. Next, the shoulder strap 46 may be fastened under the arm and around the shoulder of the user 60, after which the user 60 may stand safely or may be assisted to stand with the balance harness, and the pelvic suspension saddle and brace assembly 28 placed under the pelvis of the user 60. The rear attachment strap or straps 42 and/or the front attachment strap or straps 44 may then be adjusted to impart an ambulatory stature to and lift the user 60, after which the treadmill platform 51 of the treadmill 50 may be rolled in place under the user 60. The treadmill 50 may then be operated to enable the user 60 to ambulate in place on level terrain as the user 60 simulates a walking motion on the treadmill platform 51 for corrective gait training of the user 60, as was heretofore described with respect to use of the device 1 in FIG. 1.

It will be appreciated by those skilled in the art that a wide range of potential users may benefit by training using the device 1. These users include but are not limited to those with severe orthopedic or neurological mobility impairments, users who experience debilitations due to aging and users who seek fitness training and weight loss, and users training for high level sports seeking stride lengthening, overspeed training and unweighted aerobic conditioning without the need for recovery days. Unweighted training using the device 1 allows users to train for very long periods of time compared to conventional devices, substantially without restriction to movement of the body as may be attained in unaided outdoor walking or running. Moreover, the device 1 allows a user 60 to move in a corrected gait pattern much faster than the limitations of their pathologies (stroke, spinal cord injury, Parkinson's, etc.) or orthopedic complications would otherwise allow. This corrected fast gait movement greatly facilitates the neuroplastic nature of the brain and nervous system in connecting new pathways between the brain, nerves and muscles, resulting in a high degree of functional carryover of the fast and corrected gait into the user's unassisted, over-the-ground ambulatory ability as seen in multiple studies. Furthermore, orthopedic surgery recovery is greatly accelerated and correction of gait abnormalities is viable and consistent.

The device 1 allows individuals and athletes to enhance their sport performance abilities through very fast unweighted walking and running to facilitate stride lengthening, over-speed coordination, muscle training and aerobic conditioning with a high degree of functional carryover into the unassisted, over-the-ground ability of the individual or athlete. The device 1 further allows exercise, training or therapy on consecutive days at higher intensities for longer durations without risk of injury from cumulative impact, from mobility-impaired patients to highly-competitive athletes. This allows athletes and therapy patients to exercise and maintain fitness while recovering from injuries, actually accelerating recovery from injuries or surgery. Moreover, the shoulder strap 46 or balance harness (not shown) assists users 60 having balance impairments and others such as the aged who may require additional assistance for safety purposes while walking or running even without the pelvic suspension saddle and brace assembly 28. Moreover, the device 1 allows for differential training such as training hard on one leg while the other leg is held up or worked lightly, allowing patients to aerobically train while an injured limb is favored. Therefore, the device 1 offers athletic, fitness and disability workouts for users 60 having an injured or missing limb or intense training through rehabilitation of injury or disability. In some embodiments, the device 1 can be readily disassembled for travel with sports teams to facilitate or continue training of athletes away from a home gym. The device 1 facilitates conversion of a treadmill 50 into an effective BWSTT equipment at a fraction of the cost of alternative conventional devices.

In the various embodiments, the unweighted training device 1 may transfer the body weight of a user 60 to the device frame 2 by holding the pelvic ischial tuberosities or, alternately, the sacrum at the coccyx in counterpoise against the pelvic hip bones or ASIS in the saddle 32 and against the user brace 40 of the pelvic suspension saddle and brace assembly 28, allowing a zero to 100% unweighting of the user 60 while facilitating corrected gait training throughout the range of human ambulation. The device 1 may have particularly effective application in the fields of neurological and orthopedic therapy and personal and sport fitness training.

The device 1 facilitates pain-free exercise and gait training of the user 60 at any intensity or duration by facilitating complete unweighting and body support between steps of the user 60 on the treadmill platform 60. For neurologically-impaired patients, the extra body support from the saddle 32 allows many clients to experience marked and documentable progress and functional improvements in normalizing gait, improving walking and running speed, increasing exercise intensity, smoothing gait and improvements in trunk and core control that are rapid and carry over to normal walking after training. The saddle 32 supports the user 60 100% between steps on the treadmill platform 51, making the user 60 feel more stable, secure and confident so the user 60 is better able to work beyond his or her limitations. The pelvic suspension saddle and brace and harness assembly 28 assists users 60 who may be too weak to stand, who have significant balance impairments or those who have spinal compression problems and therefore require decreased spinal pressure to tolerate standing and walking.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above described embodiments, methods, and examples, but by all embodiments and methods within the scope and spirit of the disclosure such as the application and use of the unique pelvic suspension saddle and brace assembly lifting the pelvis to embodiments of exterior frame for use outdoors, or for use in ambulation and corrected gait training for sport, therapy or rehabilitation.

What is claimed is:

1. An unweighted therapy, exercise and training device, comprising:

a device frame including:

a device frame base having a pair of spaced-apart side base frame segments, a front base frame portion carried by the side base frame segments, a rear base frame portion carried by the side base frame segments in spaced-apart relationship to the front base frame portion and a treadmill space formed by the side base frame segments, the front base frame portion and the rear base frame portion and sized and configured to accommodate a treadmill platform of a treadmill;

an upper frame portion having a front frame segment carried by the front base frame portion of the device frame base and a curved top frame segment extending from the front frame segment and carried by the rear base frame portion of the device frame base and having a frame interior formed by the front frame segment and the rear frame segment;

a pelvic suspension saddle and brace assembly disposed in the frame interior, the pelvic suspension saddle and brace assembly including:

a generally elongated assembly frame suspended from the device frame in the frame interior;

a user brace carried by the assembly frame; and a saddle carried by the assembly frame with the user brace, the saddle selectively adjustable in position along the assembly frame.

2. The device of claim 1 further comprising a treadmill having a treadmill platform disposed in the treadmill space of the device frame base.

3. The device of claim 1 further comprising a plurality of frame wheels and wherein the device frame is carried by the frame wheels.

4. The device of claim 1 further comprising a plurality of attachment straps attaching the pelvic suspension saddle and brace assembly to the device frame.

5. The device of claim 4 wherein the plurality of attachment straps comprises at least one rear attachment strap and at least one front attachment strap.

6. The device of claim 5 further comprising at least one shoulder strap carried by the device frame.

7. An unweighted therapy, exercise and training device, comprising:

a device frame including:

a device frame base having a pair of spaced-apart side base frame segments, a front base frame portion carried by the side base frame segments, a rear base frame portion carried by the side base frame segments in spaced-apart relationship to the front base frame portion and a treadmill space formed by the side base frame segments, the front base frame portion and the rear base frame portion and sized and configured to accommodate a treadmill platform of a treadmill;

an upper frame portion having a front frame segment carried by the front base frame portion of the device frame base and a curved top frame segment extending from the front frame segment and carried by the rear base frame portion of the device frame base and having a frame interior formed by the front frame segment and the rear frame segment;

a pelvic suspension saddle and brace assembly having a generally elongated assembly frame suspended from the device frame in the frame interior, a saddle support shaft upward-standing from the assembly frame, a saddle carried by the saddle support shaft and an adjustable, padded, generally semicircular user brace carried by the assembly frame with the user brace in spaced-apart relationship to the saddle, the saddle support shaft selectively adjustable in position along the assembly frame.

8. The device of claim 7 further comprising a treadmill having a treadmill platform disposed in the treadmill space of the device frame base.

9. The device of claim 7 further comprising a plurality of frame wheels and wherein the device frame is carried by the frame wheels.

10. The device of claim 7 further comprising a brace support shaft carried by the assembly frame and wherein the user brace is adjustably carried by the brace support shaft.

11. The device of claim 7 further comprising a plurality of attachment straps attaching the assembly frame of the pelvic suspension saddle and brace assembly to the device frame.

12. The device of claim 11 wherein the plurality of attachment straps comprises at least one rear attachment strap and at least one front attachment strap.

13. The device of claim 12 further comprising at least one shoulder strap carried by the device frame.

14. An unweighted therapy and training device, comprising:

a device frame including:

a device frame base having a pair of spaced-apart side base frame segments, a front base frame portion carried by the side base frame segments, a rear base frame portion carried by the side base frame segments in spaced-apart relationship to the front base frame portion and a treadmill space sized formed by the side base frame segments, the front base frame portion and the rear base frame portion and configured to accommodate a treadmill platform of a treadmill;

an upper frame portion having a front frame segment carried by the front base frame portion of the device frame base, a curved top frame segment extending from the front frame segment and carried by the rear base frame portion of the device frame base and a frame interior formed by the front frame segment and the rear frame segment; and at least one rear attachment strap carried by the rear frame segment of the upper frame portion;

at least one front attachment strap carried by the front frame segment of the upper frame portion; and a pelvic suspension saddle and brace assembly having a generally elongated assembly frame carried by the at least one rear attachment strap and at least one front attachment strap and disposed in the frame interior of the upper frame portion, a saddle support shaft carried by the assembly frame, a saddle carried by the saddle support shaft and an adjustable, padded, generally semicircular user brace carried by the assembly frame in spaced-apart relationship to the saddle.

15. The device of claim 14 further comprising a treadmill having a treadmill platform disposed in the treadmill space of the device frame base.

16. The device of claim 14 further comprising a plurality of frame wheels and wherein the device frame is carried by the frame wheels.

17. The device of claim 14 further comprising at least one shoulder strap carried by the device frame.

18. The device of claim 14 further comprising a brace support shaft carried by the assembly frame and wherein the user brace is adjustably carried by the brace support shaft.

* * * * *